US005803168A

United States Patent [19]

Lormand et al.

[11] Patent Number: 5,803,168

[45] Date of Patent: Sep. 8, 1998

[54] TUBING INJECTOR APPARATUS WITH TUBING GUIDE STRIPS

[75] Inventors: Terry N. Lormand, Kinder; Ally D. Howard, Lake Charles; Sonya F. Savant, Maurice, all of La.

[73] Assignee: Halliburton Company, Duncan, Okla.

[21] Appl. No.: 499,500

[22] Filed: Jul. 7, 1995

[51] Int. Cl.[6] ..... E21B 19/22

[52] U.S. Cl. ..... 166/77.2; 166/85.5

[58] Field of Search ..... 166/77.3, 77.2, 166/77.1, 85.5

[56] References Cited

U.S. PATENT DOCUMENTS

| | | | |
|---|---|---|---|
| 3,285,485 | 11/1966 | Slator | 166/77.3 |
| 3,841,407 | 10/1974 | Bozeman | 166/77.3 |
| 5,234,053 | 8/1993 | Connell | 166/250 |
| 5,279,364 | 1/1994 | Jantzen et al. | 166/77.3 |
| 5,454,419 | 10/1995 | Vloedman | 166/77.2 |
| 5,638,904 | 6/1997 | Misselbrook et al. | 166/77.2 |

OTHER PUBLICATIONS

Otis Engineering Corporation Products and Services Catalog, 1989, pp. 284–290.

*Primary Examiner*—Hoang C. Dang
*Attorney, Agent, or Firm*—Stephen R. Christian; Neal R. Kennedy

[57] ABSTRACT

A tubing injector apparatus for guiding coiled tubing and inserting the tubing into a well. The apparatus includes a tubing guide portion which has a curvilinear first frame and a curvilinear second frame spaced from the first frame. An elongated first guide track is attached to the first frame, and a second guide track is attached to the second frame. The guide tracks are adapted for sliding engagement by the tubing as the tubing is moved through the injector apparatus. The guide strips are preferably made of a self-lubricating material so that the tubing moves easily.

20 Claims, 3 Drawing Sheets

TUBING INJECTOR APPARATUS WITH TUBING GUIDE STRIPS

BACKGROUND OF THE INVENTION

1. Field of the Invention

This invention relates to injector apparatus for guiding coiled tubing and inserting the coiled tubing into a well, and more particularly, to an injector with a guide portion having guide strips rather than rollers for guiding the tubing as it is moved through the apparatus.

2. Description of the Prior Art

After a well has been completed, it is necessary to periodically service the well. There are many occasions where the service procedure is carried out using coiled tubing. Such tubing is relatively small in diameter and is inserted into the wellhead through a lubricator assembly or stuffing box. Typically, there is a pressure differential in the well so that the well is a closed chamber producing oil or gas or a mixture thereof from the pressurized well. The tubing that is inserted into the well is normally inserted through a lubricator mechanism which seals the well for pressure retention in the well. The tubing is inserted by an injector which generally incorporates a set of blocks which straighten the tubing. The tubing is flexible and can bend around a radius of curvature and is supplied on a drum or reel and spooled off by the injector.

One such injector is the Otis reeled tubing injector which utilizes grooved gripper blocks which are attached to a gripper chain. There are a pair of such chains positioned on opposite sides of the tubing. Each gripper chain is driven by a drive sprocket and guided by an idler sprocket which are rotatably mounted in a rigid frame.

A curvilinear gooseneck tubing guide apparatus forms an upper portion of the injector. This gooseneck tubing guide includes a curvilinear first frame portion with a set of rollers thereon which support and guide the tubing as it is moved through the injector. Spaced from the first frame portion is a second frame portion also having a set of rollers thereon which are on the opposite side of the tubing from the first set of rollers and which also act to guide the tubing. The gooseneck tubing guide is pivotable for easy alignment with the tubing reel.

The rollers on the gooseneck tubing guide are subjected to weather and also to well fluids which might drip from the tubing when it is moved out of the well. Either of these can cause the rollers to rust or become dirty which may prevent them from rolling. A stuck or frozen roller will cause increased friction when moving the tubing into or out of the well which might result in damage to the tubing. This requires frequent replacement of the bearings in the rollers or total replacement of the rollers themselves.

The present invention solves this problem with the prior art tubing injector by replacing the rollers with tubing guide strips or tracks which are preferably made of advanced plastics which are substantially self-lubricating. In this way, the tubing may be slidingly moved along these guide strips without significant frictional restrictions.

SUMMARY OF THE INVENTION

The tubing injector apparatus of the present invention comprises a tubing guide apparatus or portion and a tubing injector apparatus or portion. The guide apparatus comprises an elongated first frame, an elongated second frame spaced from the first frame, an elongated first guide track or strip attached to the first frame and having a first tubing guide surface thereon, and a second guide track or strip attached to the second frame and spaced from the first guide track. The second guide track defines a second tubing guide surface thereon. The first and second tubing guide surfaces are adapted for sliding engagement with tubing moved by the injector portion. In the preferred embodiment, the first and second frames are curvilinear and substantially parallel to one another, and the first and second guide tracks conform to the curvature of the first and second frames.

The first tubing guide surface defines an elongated groove therein adapted for receiving at least a portion of the tubing. Preferably, this groove has a substantially V-shaped cross section originally, but the invention is not intended to be limited to this particular configuration. The second tubing guide surface preferably has a substantially flat configuration as viewed in cross section.

In one embodiment, but not by way of limitation, the second frame is shorter than the first frame, and the second tubing guide track is shorter than the first tubing guide track.

The first and second tubing guide tracks are preferably made of a substantially self-lubricating material, such as an advanced plastic material. One preferred material is ultra-high molecular-weight crosslink polyethylene, although additional materials may also be suitable. The first and second tubing guide tracks may be manufactured in a curved form originally or the material thereof may be sufficiently flexible to allow the guide tracks to be bent to conform to the curvature of the first and second frames, respectively.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
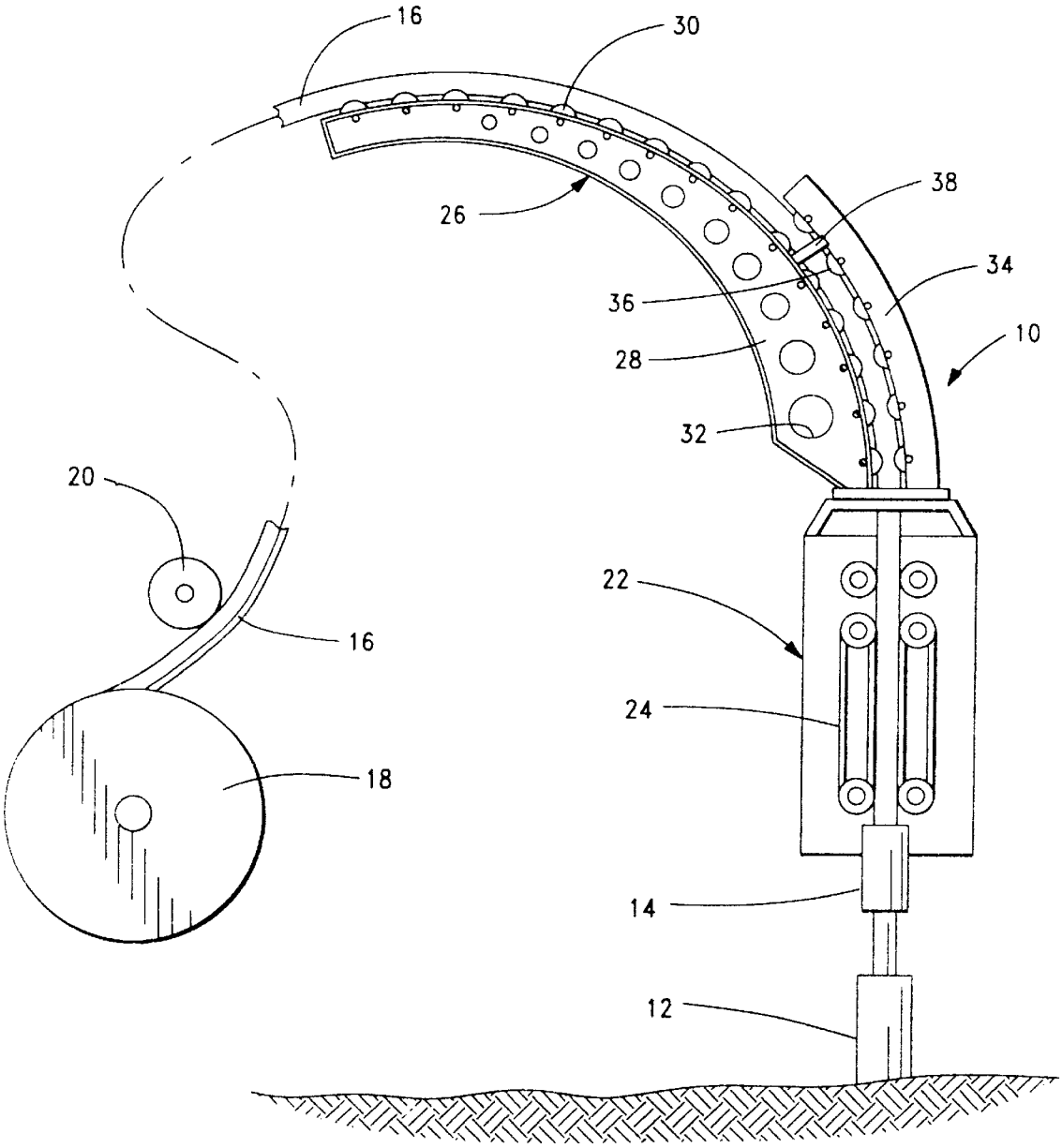
FIG. 1 PRIOR ART
FIG. 1 shows a side elevational schematic of a prior art tubing injector.
Figure 2:
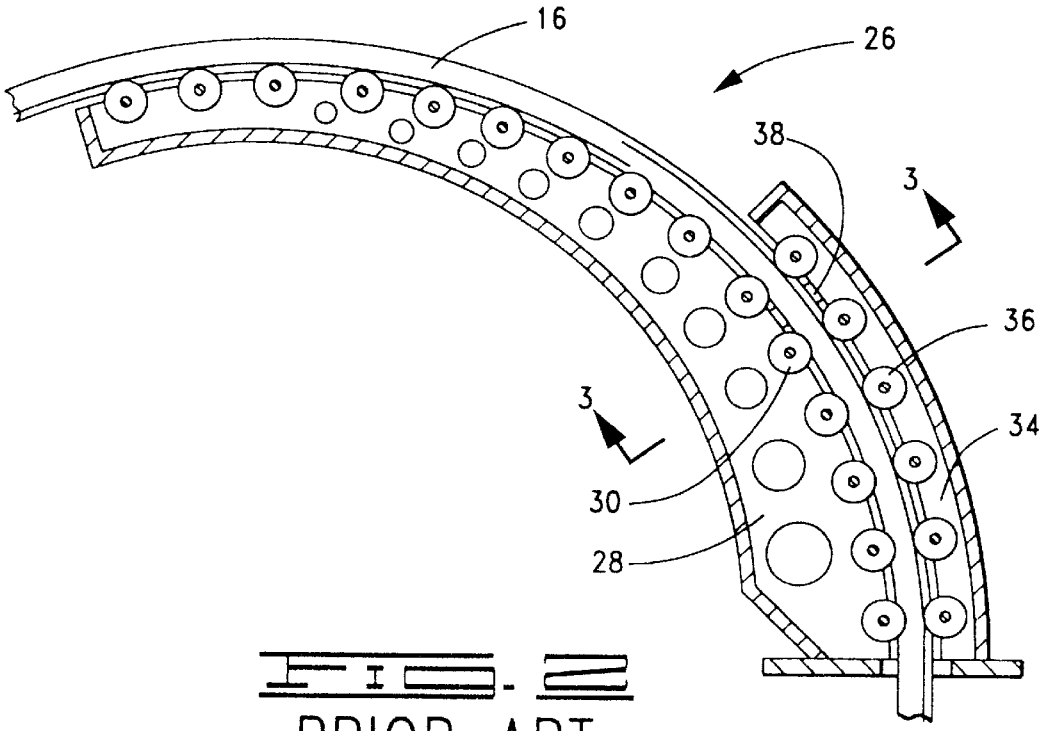
FIG. 2 PRIOR ART
FIG. 2 is a vertical cross section of the gooseneck tubing guide portion of the prior art tubing injector.
Figure 3:
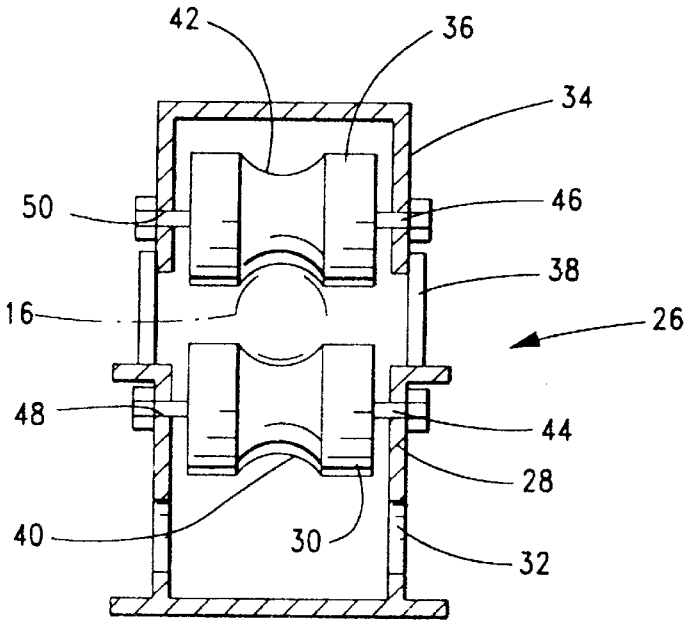
FIG. 3 PRIOR ART
FIG. 3 shows a prior art cross section taken along lines 3—3 in FIG. 2.

Referring now to the drawings, and more particularly to FIGS. 1–3, a prior art Otis reeled tubing injector apparatus is shown and generally designated by the numeral 10. Apparatus 10 is positioned over a wellhead 12 which is provided with a stuffing box or lubricator 14. Tubing 16 is provided to apparatus 10 on a large drum or reel 18, and typically is several thousand feet in length. The tubing is in a relaxed, but coiled, state when supplied from drum or reel 18. As tubing 16 comes off drum 18, it normally will pass over a measuring device 20.

The well is typically pressure isolated. That is, entry of tubing 16 into the well must be through stuffing box 14 which enables the tubing, which is at atmospheric pressure, to be placed in the well which may operate at higher pressures. Entry into the well requires that the tubing be substantially straight. To this end, apparatus 10 incorporates an injector portion 22 which is constructed with drive chains which carry blocks adapted for gripping tubing 16. The details of drive chains and blocks 24 are known in the art.

A gooseneck tubing guide portion is attached to the upper end of injector portion 22. Typically, tubing guide portion 26 is pivotable about a vertical axis with respect to injector portion 22.

Gooseneck tubing guide portion 26 includes a curvilinear first or bottom frame 28 having a plurality of first or bottom rollers 30 rotatably disposed thereon. Bottom frame 28 includes a plurality of lightening holes 32 therein.

Spaced from bottom frame 28 is a second or top frame 34 which has a plurality of second or top rollers 36 rotatably disposed thereon. Top rollers 36 generally face at least some of bottom rollers 30. In the embodiment illustrated, the length of curvilinear top frame 34 is less than that of curvilinear bottom frame 28. The distal end of top frame 34 is attached to bottom frame 28 by a bracket 38.

Referring now to FIG. 3, bottom rollers 30 have a circumferential groove 40 therein, and top rollers 36 have a similar circumferential groove 42 therein. Facing rollers 30 and 36 are spaced such that tubing 16 is generally received in grooves 40 and 42 to guide and straighten the tubing as it enters injector portion 22 of apparatus 10.

Bottom rollers 30 are supported on first shafts 44, and similarly, top rollers 36 are supported on second shafts 46. Shafts 44 are disposed through a plurality of aligned pairs of holes 48 in bottom frame 28. Shafts 46 are disposed through holes 50 in top frame 34. Rollers 30 and 36 are supported on shafts 44 and 46, respectively, by bearings (not shown).

Figure 4:
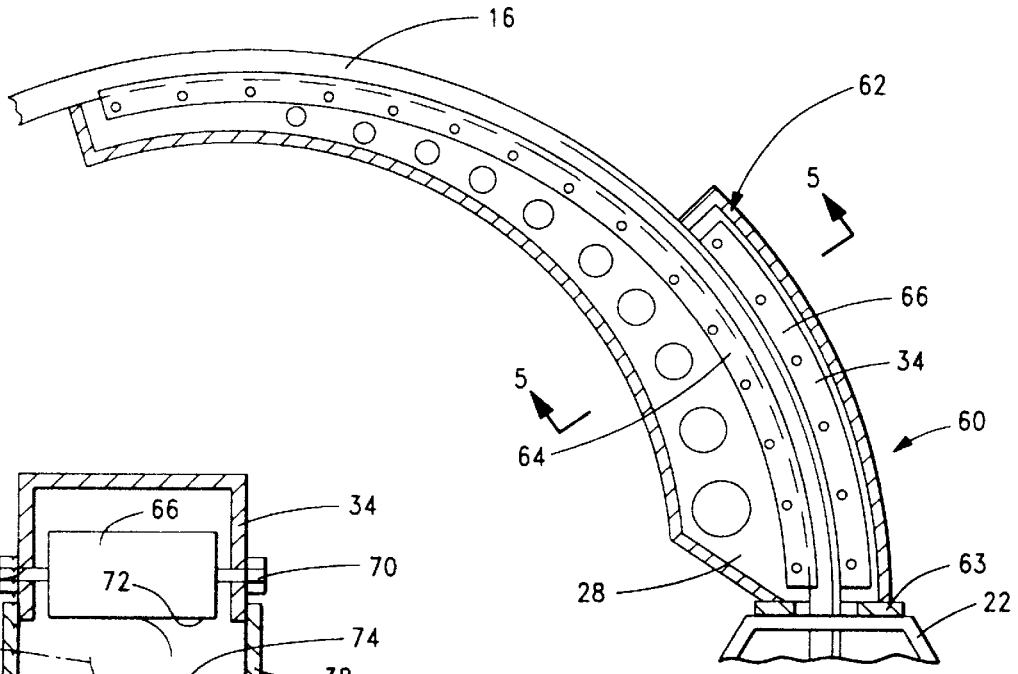
FIG. 4 illustrates a vertical cross section through the gooseneck tubing guide portion of the tubing injector apparatus with tubing guide strips of the present invention.
Figure 5:
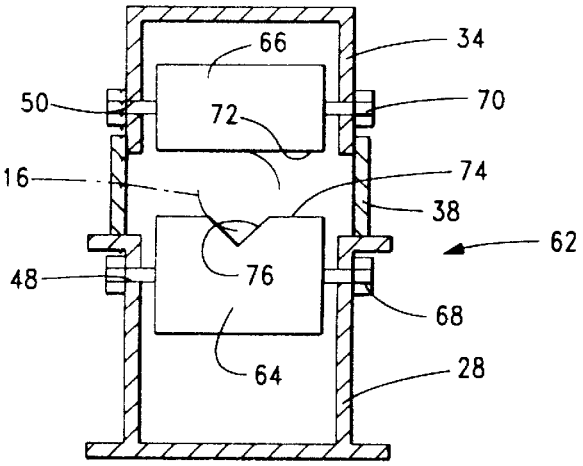
FIG. 5 is a cross section taken along lines 5—5 in FIG. 4.

Referring now to FIGS. 4 and 5, the tubing injector apparatus with guide blocks of the present invention is shown and generally designated by the numeral 60. Apparatus 60 includes the same injector portion 22 as prior art apparatus 10. Apparatus 60 also includes a gooseneck tubing guide portion 62 which is pivotally attached to injector portion 22 by a base 63 in a manner identical to prior art apparatus 10.

Tubing guide portion 62 of the present invention comprises the same frame components as prior art tubing guide portion 26. That is, tubing guide portion 62 has curvilinear first or bottom frame 28 extending upwardly from base 63. A curvilinear second or top frame 34 also extends upwardly from base 63. Top frame 34 is spaced from bottom frame 28 and substantially parallel thereto. In the illustrated embodiment, top frame 34 is shorter than bottom frame 28. The same bracket 38 attaches the distal end of top frame 34 to bottom frame 28.

The terms "top" and "bottom" as used herein relate to the fact that bottom frame 28 is always substantially below tubing 16, and top frame 34 is always substantially above the tubing. Of course, as tubing 16 enters injector portion 22, it is substantially vertical.

Rather than the prior art rollers, tubing guide portion 62 of the present invention utilizes a first or bottom fixed guide strip or track 64 and a second or top fixed guide strip or track 66 spaced from the bottom guide strip. Top guide strip 66 is substantially parallel to bottom guide strip 64, and in the illustrated embodiment, is shorter than the bottom guide strip. Bottom guide strip 64 is an elongated member which generally follows the curvature of bottom frame 28. Bottom guide strip 64 may be originally formed in this curvilinear shape or may be made of a material which is flexible enough to conform to such curvature. Similarly, top guide strip 66 generally follows the curvature of top frame 34. Top guide strip 66 may also be originally formed with a curvature or made of a material which is flexible enough to conform to the curvature of top frame 34. As will be further discussed herein, this flexible material may be an advance plastic.

In the preferred embodiment, bottom guide strip 64 is attached by bolts or screws 68 which extend through holes 48 in bottom frame 28 and engage the bottom guide strip. In a similar fashion, a plurality of bolts or screws 70 extend through holes 50 in top frame 34 to engage top guide strip 66 and hold it in place. Thus, it will be seen by those skilled in the art, that the prior art apparatus 10 may be modified to the configuration of new apparatus 60 by removing rollers 30 and 36 and shafts 40 and 46 and attaching bottom guide strip 64 and top guide strip 66 with bolts 68 and 70 through existing holes 48 and 50.

Figure 6:
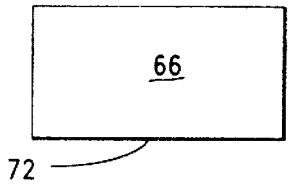
FIG. 6 shows a detailed cross section of the top guide strip.
Figure 7:
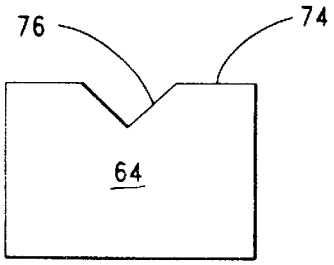
FIG. 7 shows a detailed cross section of the bottom guide strip as initially installed.

In the embodiment shown, top guide strip 66 has a tubing guide surface 72 which faces bottom guide strip 64. Bottom guide strip 66 has a tubing guide surface 74 which generally faces tubing guide surface 72 of top guide strip 66. Tubing guide surface 74 on bottom guide strip 64 may be referred to as a first tubing guide surface, and tubing guide surface 72 on top guide strip 64 may be referred to as a second tubing guide surface. First and second tubing guide surfaces 74 and 72 are spaced from one another and are substantially parallel. As seen in FIG. 5, second tubing guide surface 72 is substantially flat as seen in cross section. First tubing guide surface 74 is at least partially flat, but preferably defines an elongated V-shaped groove 76 therein. These configurations are illustrated in enlarged detail in FIGS. 6 and 7. Other groove shapes may also be used.

Bottom guide strip 64 and top guide strip 66 are spaced such that tubing 16 will extend partially into groove 76 in bottom guide strip 64, and an opposite side of tubing 16 will generally contact flat surface 72 of top guide strip 66.

Bottom and top guide strips 64 and 66 are preferably made of a generally self-lubricating material such as an advanced plastic. One preferred material is ultra-high molecular-weight, crosslinked polyethylene, but the invention is not intended to be limited to such material.

Figure 8:
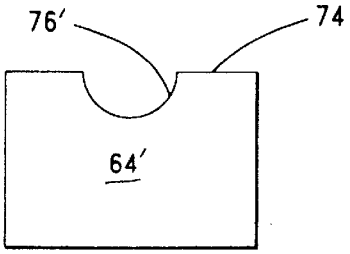
FIG. 8 is a detailed cross section of the bottom guide strip illustrating wear thereon as a result of sliding movement of the tubing.

As injector portion 22 moves tubing 16 in or out of the well, the tubing will slide along second tubing guide surface 72 and in groove 76 of first tubing guide surface 74. Eventually, groove 76 in bottom guide strip 64 will wear to the configuration indicated by numeral 64' in FIG. 8. That is, as the tubing moves along groove 76 it will eventually wear into a generally curved groove 76'. However, it has been shown that even with such wear, tubing guide portion 62 functions essentially as well as when bottom guide strip 64 is in the original configuration shown in FIG. 7. That is, wear on bottom guide strip 64 does not cause rapid degradation in the movement of tubing 16 through apparatus 60.

Eventually, of course, bottom and top guide strips 64 and 66 may need to be replaced. This is done by simply removing bolts 68 and 70 and installing new guide strips. The repair frequency on guide strips 64 and 66 has been shown to be considerably less than is necessary for repairing or replacing rollers 30 and 36 in prior art apparatus 10. Also, the cost of the two guide strips 64 and 66 is much less than the plurality of rollers in the prior art device.

It will be seen, therefore, that the tubing injector apparatus with guide strips of the present invention is well adapted to carry out the ends and advantages mentioned, as well as those inherent therein. While a presently preferred embodiment of the invention has been shown for the purposes of this disclosure, numerous changes in the arrangement and construction of parts may be made by those skilled in the art. All such changes are encompassed within the scope and spirit of the appended claims.

What is claimed is:

1. A guide apparatus for a tubing injector comprising:

an elongated first frame;

an elongated second frame spaced from said first frame;

an elongated first guide track attached to said first frame and having a first tubing guide surface thereon; and a second guide track attached to said second frame and spaced from said first guide track, said second guide track defining a second tubing guide surface thereon, said first and second tubing guide surfaces having means for providing sliding engagement with tubing moved by the tubing injector.

2. The apparatus of claim 1 wherein said first tubing guide surface defines a groove therein adapted for receiving at least a portion of the tubing.

3. The apparatus of claim 2 wherein said groove has a substantially V-shaped cross section.

4. The apparatus of claim 1 wherein said second tubing guide surface is substantially flat as viewed in cross section.

5. The apparatus of claim 1 wherein said second tubing guide track is shorter than said first tubing guide track.

6. The apparatus of claim 1 wherein said first and second tubing guide tracks are made of a plastic material.

7. The apparatus of claim 6 wherein said plastic material is ultra-high molecular-weight crosslink polyethylene.

8. The apparatus of claim 1 wherein:

said first and second frames are curvilinear; and said first and second tubing guide tracks are made from a flexible material adapted for conforming to the curvature of said first and second frames, respectively.

9. The apparatus of claim 1 wherein said first and second tubing guide surfaces are substantially parallel.

10. A tubing guide apparatus for use on an injector for injecting and withdrawing tubing from a well, said apparatus comprising:

a base adapted for attachment to the injector;

a first curvilinear frame extending upwardly from said base;

a second curvilinear frame extending upwardly from said base, said second frame being spaced from said first frame and substantially parallel thereto;

a first fixed guide strip attached to said first frame and defining a first tubing guide surface thereon adapted for sliding engagement with tubing moved by the injector; and a second fixed guide strip attached to said second frame and defining a second tubing guide surface thereon adapted for sliding engagement with the tubing on an opposite side of the tubing from said first tubing guide strip.

11. The apparatus of claim 10 wherein said second tubing guide surface is substantially parallel to at least a portion of said first tubing guide surface.

12. The apparatus of claim 10 wherein said second guide strip is shorter than said first guide strip.

13. The apparatus of claim 10 wherein said first tubing guide surface defines an elongated groove therein adapted for receiving at least a portion of the tubing therein.

14. The apparatus of claim 13 wherein said groove has a substantially V-shaped cross section.

15. The apparatus of claim 10 wherein said second tubing guide surface has a substantially flat cross-sectional shape.

16. The apparatus of claim 10 wherein said first and second guide strips are made of substantially self-lubricating material.

17. The apparatus of claim 16 wherein said material is plastic.

18. The apparatus of claim 17 wherein said plastic material is ultra-high molecular-weight crosslink polyethylene.

19. The apparatus of claim 10 wherein:

said first guide strip is made of a flexible material such that it is configurable to conform with the curvature of said first frame; and said second guide strip is made of a flexible material such that it is configurable to conform with the curvature of said second frame.

20. The apparatus of claim 19 wherein said flexible material is ultra-high molecular-weight crosslink polyethylene.

* * * * *